US010820771B2

(12) United States Patent
Blum et al.

(10) Patent No.: US 10,820,771 B2
(45) Date of Patent: Nov. 3, 2020

(54) CLEANING ROLLER

(71) Applicant: Vorwerk & Co. Interholding GmbH, Wuppertal (DE)

(72) Inventors: Michael Blum, Wuppertal (DE); Sabine Schweppe, Monheim (DE)

(73) Assignee: Vorwerk & Co. Interholding GmbH, Wuppertal (DE)

( * ) Notice: Subject to any disclaimer, the term of this patent is extended or adjusted under 35 U.S.C. 154(b) by 293 days.

(21) Appl. No.: 15/754,053

(22) PCT Filed: Oct. 5, 2016

(86) PCT No.: PCT/EP2016/073710

§ 371 (c)(1),
(2) Date: Feb. 21, 2018

(87) PCT Pub. No.: WO2017/060261

PCT Pub. Date: Apr. 13, 2017

(65) Prior Publication Data

US 2018/0249877 A1 Sep. 6, 2018

(30) Foreign Application Priority Data

Oct. 7, 2015 (DE) ..... 10 2015 117 083

(51) Int. Cl.
*A47L 11/40* (2006.01)
*A47L 11/19* (2006.01)
(Continued)

(52) U.S. Cl.
CPC ..... *A47L 11/4041* (2013.01); *A47L 9/0477* (2013.01); *A47L 11/085* (2013.01); *A47L 11/19* (2013.01); *A47L 11/26* (2013.01)

(58) Field of Classification Search
CPC ..... A47L 9/04; A47L 9/0455; A47L 11/19; A47L 11/40
See application file for complete search history.

(56) References Cited

U.S. PATENT DOCUMENTS 1,894,361 A * 1/1933 Shank ..... A47L 9/0477 15/141.2
2,026,414 A * 12/1935 Burch ..... A47L 11/33 15/48
(Continued)

FOREIGN PATENT DOCUMENTS

CA 1034855 A 7/1978
CN 101516247 A 8/2009
(Continued)

OTHER PUBLICATIONS

International Search Report of PCT/EP2016/073710, dated Jan. 4, 2017.
(Continued)

*Primary Examiner* — Michael D Jennings
(74) *Attorney, Agent, or Firm* — Collard & Roe, P.C.

(57) ABSTRACT

A cleaning roller for a cleaning appliance, in particular a wiping roller for a wet cleaning appliance, or a cleaning appliance having such a cleaning roller processes an area to be cleaned. The cleaning roller has a roller core that can rotate about a longitudinal axis and has a bearing for a drive shaft and a roller cover surrounding the roller core in the circumferential direction. The roller core, based on a cross section perpendicular to the longitudinal axis, has several spring elements formed beside one another in the circumferential direction of the cleaning roller, each of which extends from the bearing to the roller cover.

6 Claims, 7 Drawing Sheets

(51) Int. Cl.

| | |
|---|---|
| ***A47L 9/04*** | (2006.01) |
| ***A47L 11/08*** | (2006.01) |
| ***A47L 11/26*** | (2006.01) |

(56) References Cited

U.S. PATENT DOCUMENTS

| | | | | |
|---|---|---|---|---|
| 2,178,917 | A * | 11/1939 | Pullen | A47L 11/33 15/41.1 |
| 2,226,581 | A * | 12/1940 | Richardson | A47L 11/33 15/41.1 |
| 3,735,535 | A | 5/1973 | Waller | |
| 3,837,038 | A * | 9/1974 | Kimzey | A47L 11/24 15/349 |
| 5,435,038 | A * | 7/1995 | Sauers | A47L 9/0455 15/179 |
| 6,003,198 | A * | 12/1999 | Stegens | A47L 9/0455 15/179 |
| 7,921,497 | B2 | 4/2011 | Cook et al. | |
| 2002/0004961 | A1* | 1/2002 | Nishina | A61G 5/10 15/53.4 |
| 2002/0032948 | A1* | 3/2002 | Ahn | A47L 5/30 15/389 |
| 2003/0159240 | A1* | 8/2003 | Mertes | A47L 9/0455 15/392 |
| 2006/0075599 | A1* | 4/2006 | Kimmerle | A47L 9/0455 15/383 |
| 2015/0238061 | A1 | 8/2015 | Adams et al. | |

FOREIGN PATENT DOCUMENTS

| | | | |
|---|---|---|---|
| CN | 102029265 | A | 4/2011 |
| CN | 102046060 | A | 5/2011 |
| DE | 10 2007 052 982 | A1 | 5/2009 |
| DE | 10 2008 009 617 | A1 | 8/2009 |
| EP | 1 378 377 | A2 | 1/2004 |
| EP | 1 479 336 | A2 | 11/2004 |
| FR | 2297144 | A1 | 8/1976 |

OTHER PUBLICATIONS

Chinese Office Action dated Mar. 4, 2020, including Search Report, in Chinese Application No. 201680056533.9 with English translation of Chinese Office Action.

* cited by examiner 14
13
2
12
11
15
1
3

CLEANING ROLLER

CROSS REFERENCE TO RELATED APPLICATIONS

This application is the National Stage of PCT/EP2016/073710 filed on Oct. 5, 2016, which claims priority under 35 U.S.C. § 119 of German Application No. 10 2015 117 083.3 filed on Oct. 7, 2015, the disclosures of which are incorporated by reference. The international application under PCT article 21(2) was not published in English.

AREA OF TECHNOLOGY

The invention relates to a cleaning roller for a cleaning appliance for processing a surface to be cleaned, in particular a wiping roller for a wet cleaning appliance, wherein the cleaning roller has a roller core that can rotate around a longitudinal axis, with a bearing for a drive shaft and a roller cover surrounding the roller core in the circumferential direction.

In addition, the invention relates to a cleaning appliance with a rotatable cleaning roller, wherein the cleaning roller has a roller core that can rotate around a longitudinal axis with a bearing for a drive shaft and a roller cover surrounding the roller core in the circumferential direction.

PRIOR ART

Cleaning rollers of the aforementioned kind are known in prior art. The latter are used for wet or dry cleaning surfaces.

The cleaning roller normally has a cylindrical roller core made out of foam. The roller core can be rotated around a longitudinal axis, which is accommodated centrally in the roller core. To this end, the roller core has a bearing for a drive shaft of the cleaning appliance. A roller cover is secured on the outside of the roller core. This cover usually consists of a microfiber material, and can preferably be removed from the roller core.

Publication DE 10 2007 052 982 A1 discloses a cleaning appliance with a cleaning roller, along with a cleaning roller for such a cleaning appliance, wherein the cleaning roller has a roller axis that has detachably secured to it a tubular cleaning element, wherein this cleaning element has a tubular soft-foam hollow body. A cleaning cover is applied on the outside of the foam hollow body and fixedly connected therewith.

Proceeding from the aforementioned prior art, the object of the invention is to further develop a cleaning roller or a cleaning appliance with such a cleaning roller, in particular as relates to an optimized cleaning effect.

SUMMARY OF THE INVENTION

In order to achieve the aforementioned object, the invention proposes that the roller core of the cleaning roller have several spring elements arranged one next to the other in the circumferential direction of the cleaning roller relative to a cross section perpendicular to the longitudinal axis, which each extend from the bearing to the roller cover.

The roller core thus has a plurality of spring elements, which are arranged around the bearing. The spring elements extend in the direction of the longitudinal axis of the cleaning roller on the one hand, and between the bearing and roller cover on the other. The spring elements are here advantageously designed as flat disks, which are arranged on the bearing and point in the direction of the roller cover. As a result of this configuration, the roller cover relative to a cleaning roller with a conventional foam roller core is pressed with an elevated spring force against the surface to be cleaned, and lies on the surface to be cleaned with a larger contact surface. Due to the magnified spring force of the spring elements by comparison to prior art, the roller cover is tensioned by the spring elements when exposed to the weight force of the cleaning roller, so that the roller cover does not wrinkle during the cleaning process, which otherwise could detract from the cleaning effect. The spring force of the spring elements makes it possible to offset any unevenness on the surface to be cleaned, so that the roller cover comes into contact with as much of the surface to be cleaned as possible. The displacement or spreading of the spring elements during contact with the surface to be cleaned keeps the circumference of the cleaning roller constant, thereby preventing any wrinkling of the roller cover. The advantage to spring elements by comparison to a soft foam is that the restoring forces are stronger and act directly. In particular, the weight force is also conveyed to the edge areas of the contact surface between the cleaning roller and the surface to be cleaned.

Of course, the invention can also find application in cleaning rollers whose bearing is not formed over the entire length of the cleaning roller, but rather has bearing positions for connection with the drive shaft only at the end regions of the cleaning roller. Cross sectional planes in which no bearing is formed can thus exist in relation to various cross sectional planes in the direction of the longitudinal axis of the cleaning roller. In the sense of the invention, the spring elements then extend—relative to this cross sectional plane—in one direction from the longitudinal axis to the roller cover.

It is proposed that the spring elements be fabricated out of an elastically deformable material, in particular a plastic. Especially suitable are plastics that can be processed through extrusion or injection molding, so that the spring elements are extruded or injection molded as a mass product, and can then be stamped into spring elements. The spring elements are then layered onto the bearing of the cleaning roller. Alternatively, it is also possible that the spring elements be made out of metal, in particular metal disks.

In addition, it is proposed that a first end region of a spring element be allocated to the bearing, and a second end region of the spring element be allocated to the roller cover, wherein both the first end regions and the second end regions of adjoining spring elements are spaced apart from each other in the circumferential direction. The spring elements extend from one linear region (first end region) on the circumferential plane of the bearing to the roller cover. It is here not required that the spring elements be connected with the roller cover. In particular, it is instead recommended that the roller cover be separated from the roller core, so that it can be removed from the latter as needed and cleaned. The second end regions of the spring elements here advantageously lie on a circumferential surface of the roller core, which is designed either as a closed surface that envelops the spring elements, or as a kind of open structure, wherein the second end regions of the spring element are spaced the same distance apart from the bearing, and thus also describe a circle relative to a cross section perpendicular to the longitudinal axis of the cleaning roller. It is recommended that the first end regions and/or the second end regions be arranged equidistantly on the respective circumference, so that the roller core has uniformly arranged spring elements. Alternatively, however, a deviating embodiment can also provide that the first end regions of several spring elements be formed on the same circumferential position of the bearing, and extend to various circumferential positions of the roller cover. This yields a non-homogeneous arrangement of the spring elements inside of the roller core.

In addition, it is proposed that adjacent spring elements can be displaced relative to each other by exposing the spring elements to the weight force of the cleaning roller in such a way as to enlarge a bearing area of the roller cover on the surface to be cleaned that is tensioned between the spring elements in the circumferential direction. As a result of this configuration, two or more neighboring spring elements are displaced and spaced apart from each other through exposure to the weight force of the cleaning roller when placing the cleaning roller onto a surface to be cleaned, so that the distance between their end regions increases. The region of the roller cover allocated to the respective spring elements is thereby tensioned between the end regions of the spring elements, so as to enlarge the bearing area of the roller cover on the surface to be cleaned between the spring elements. As a consequence, a larger surface of the cleaning roller rests on the surface to be cleaned, which leads to a better cleaning result. Tensioning the bearing area prevents the roller cover from wrinkling. During exposure to a weight force of 1 kilogram, for example, the bearing area of a cleaning roller with a diameter of 45 millimeters reaches 20 to 25 millimeters (in the circumferential direction), for example. A speed of 250 to 500 revolutions per minute is here assumed for the cleaning roller, along with a length of the cleaning roller of approx. 250 millimeters.

In combination with the roller core comprised of spring elements, it is recommended that the roller cover have a textile (in particular elastic) cleaning layer, for example a microfiber layer, which keeps the circumference of the cleaning roller constant, i.e., helps prevent wrinkling, and can still be deformed to have as wide a bearing area as possible on the surface to be cleaned. The roller cover also conveys the weight force of the cleaning roller to the edge regions of the bearing area.

A possible embodiment of the invention provides that the spring elements essentially be U-shaped in design, wherein adjacent spring elements are meanderingly connected with each other, in particular in the circumferential direction. The legs of the U-shaped spring elements are here advantageously connected with each other in the area of the bearing, wherein the partial region of the U-shape lying between the legs faces toward the roller cover. If necessary, the spring elements can be arranged by means of webs on a circumferential surface of the roller core, against which the roller cover abuts. This results in a meandering structure of the spring elements between the bearing and roller cover, wherein the adjacent loops of the meandering shape are equidistantly arranged along the circumference. When exposing the spring elements to the weight force of the cleaning roller, the loops of the meandering shape arranged in the area of the surface to be cleaned are compressed, thus enlarging the bearing area of the cleaning roller. Webs arranged between the spring element and roller cover are here potentially spread open, i.e., spaced apart from each other, so that the largest possible surface of the cleaning roller rests on the surface to be cleaned. At the same time, roller cover is tensioned to counteract wrinkling.

It is proposed that the spring elements be designed radially between the bearing and roller cover. In an especially simple configuration, the spring elements are disks facing radially from the bearing to the roller cover, which in relation to a cross section perpendicular to the longitudinal axis face radially outward from the bearing. As relates to the embodiment described above with U-shaped spring elements, however, these can also be aligned radially between the bearing and roller cover, so that the axis of symmetry of a loop of the meandering shape faces in a radial direction.

Another embodiment can provide that the spring elements be sickle-shaped, curved lamellae arranged one next to the other in the circumferential direction and radial direction, the concave side of which faces the bearing. This embodiment yields an arrangement of spring elements that is known for the lamellae of an iris diaphragm, for example. The spring elements are thus arranged one above the other offset along the circumference of the bearing, wherein the first end regions and second end regions of the spring elements are offset relative to each other on the bearing or in the area of the roller cover, causing the spring elements to be arranged in part one above the other in a radial direction. The sickle-shaped curvature of the spring elements also causes them to extend in the circumferential direction of the cleaning roller, thereby yielding a radial expansion on the tumbling end regions of the bearing area on the one hand, and as large a compression in a central region of the bearing area on the other.

It is further proposed that the spring elements be pivoted to the bearing. For example, the side of the bearing facing in the direction of the roller core can have grooved receptacles for the spring elements, into which the first end regions of the spring elements engage, and can be pivoted within a defined angular range. This makes it possible to assist in spreading open adjacent spring elements, so that the spring elements can be spaced apart from each other by virtue of their elasticity on the one hand and due to their ability to pivot on the bearing on another. It can potentially also be provided that the spring elements in one embodiment be stiff, i.e., not elastic, in design, and that the spring characteristic results from connecting the spring element with the bearing, for example by using a resilient receiving element for the spring element on the bearing.

It is proposed that the spring elements be formed over the entire length of the cleaning roller in the direction of the longitudinal axis. The spring elements are here advantageously thin disks, which extend along the entire longitudinal axis of the cleaning roller on the one hand, and between the bearing and roller cover on the other. However, it can alternatively also be provided that the spring elements only be formed on specific partial sections along the longitudinal axis of the roller core. Viewed in the direction of the longitudinal axis in which spring elements are arranged, this yields regions within the roller core in which spring elements are arranged, and regions that have no spring elements, but rather are filled with a foam, for example.

According to the invention, a cleaning roller can also have various types of the spring elements described above, in particular as relates to varying partial sections along the longitudinal axis of the cleaning roller. In addition, the spring elements can be pivotably mounted on the bearing proposed above given different configurations of the spring elements, for example with regard to the U-shaped spring elements, the sickle-shaped, curved lamellae or even spring elements formed radially between the bearing and roller cover.

Also proposed with the invention is an alternative configuration of the roller core of the cleaning roller, in which the roller core has at least one air chamber. In this embodiment as well, the cleaning roller has a roller core that can rotate around a longitudinal axis, with a bearing for a drive shaft and a roller cover that envelops the roller core in the circumferential direction. The air chamber is arranged coaxially around the bearing, and also extends in the direction of the longitudinal axis. The air chamber can here be formed over the entire length of the cleaning roller, or only in partial sections along the longitudinal axis. Partial sections that have no air chamber can be filled out with a foam, for example. It can here be provided that the air chamber be designed as a single, continuous volume range in relation to a cross section perpendicular to the longitudinal axis. As an alternative, however, the roller core can also have a plurality of air chambers, which are arranged one next to the other in the circumferential direction of the roller core. Several separate air volumes here arise in the circumferential direction. The air chamber or the air chambers lying one next to the other along the circumference are applied to a rim connected with the bearing as kind of a hose. The rim is advantageously fabricated out of plastic, so that it has as low a weight as possible, and also has enough inherent rigidity to carry the air chamber and clamp it in the process. The air chamber or air chambers are only exposed to pressure of a kind that the air chamber facing the surface flattens when exposed to the weight force of the cleaning roller or cleaning appliance, and thus forms no partial circular section in a bearing area of the roller core or roller cover on the surface to be cleaned, but rather a flattened area by comparison thereto, which in light of the enlarged interaction surface enables a better cleaning of the surface to be cleaned. In addition, unevenness on the surface to be cleaned is also smoothened out, since the cleaning roller can adjust to it. The cleaning roller that has the air chamber or air chambers here resembles a wheel with an incompletely inflated tire, which flattens out when placed on a surface in the resting partial circumferential section of the tire.

To achieve a uniform cleaning result, it can also be provided that the exterior side of the roller cover have areas with long and shorter fibers, so that any unevenly distributed moisture accumulations within the roller cover can be reduced on the bearing area. In addition, the roller cover can have both bearing and non-bearing areas, which allows the roller cover to expand over as much of the surface to be cleaned as possible on the one hand, and satisfies the task of dissolving and collecting dirt.

Apart from the cleaning roller described above, the invention also proposes a cleaning appliance with a rotatable cleaning roller, in particular with a cleaning roller described above, wherein the cleaning roller has a roller core that can be rotated around a longitudinal axis, with a bearing for a drive shaft and a roller cover enveloping the roller core in the circumferential direction, wherein the roller core has several spring elements arranged one next to the other in relation to a cross section perpendicular to the longitudinal axis, which each extend from the bearing to the roller cover. The advantages resulting from the invention for the cleaning appliance can analogously be derived from the features and advantages of the cleaning roller. As a whole, then, this yields a cleaning appliance that enables an especially thorough and rapid cleaning of a surface to be cleaned.

BRIEF DESCRIPTION OF THE DRAWINGS

The invention will be explained in greater detail below based on exemplary embodiments. Shown on.

DESCRIPTION OF THE EMBODIMENTS

Figure 1:
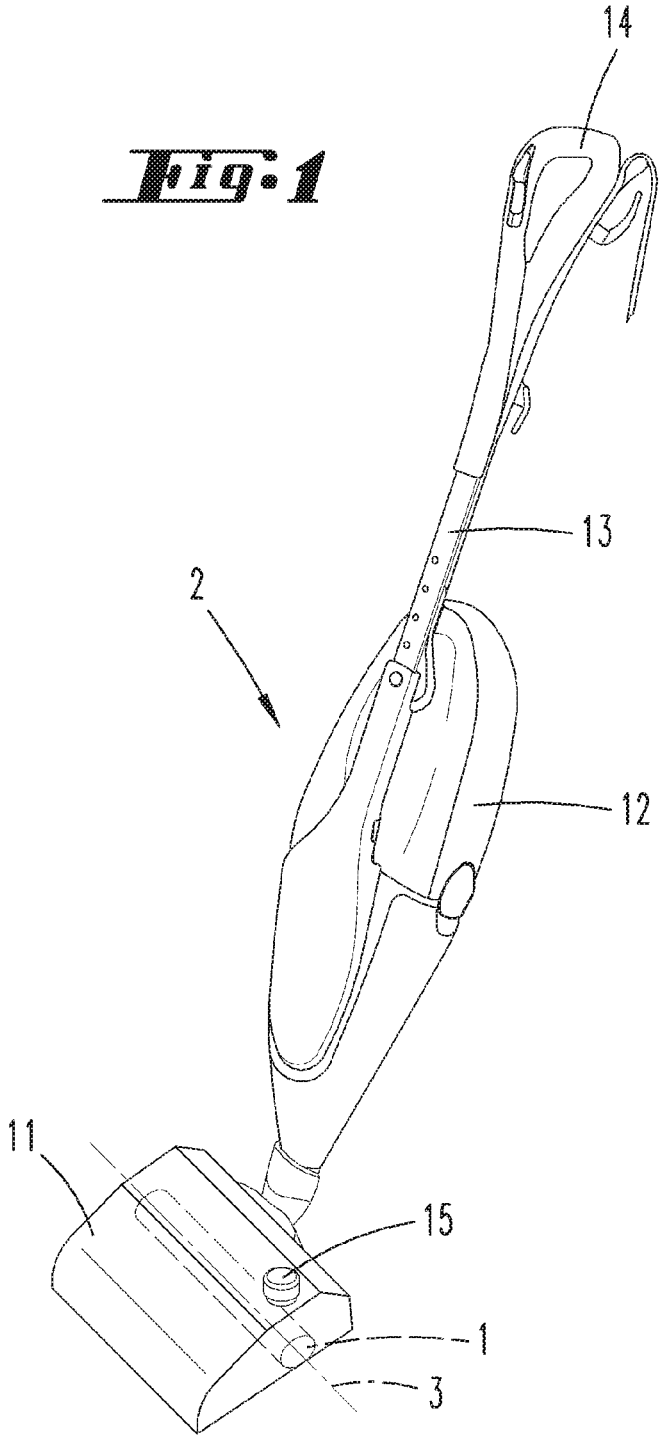
FIG. 1 is a cleaning appliance according to the invention.

FIG. 1 shows a cleaning appliance 2, which is here designed as a manually guided wet cleaning appliance. The cleaning appliance 2 has a base unit 12 and an attachment 11 arranged on the base unit 12. The attachment 11 has a cleaning roller 1, whose longitudinal axis 3 is perpendicular to a usual traversing direction of the cleaning appliance 2, specifically in relation to a cleaning movement, in which a user pushes the cleaning appliance 2 forward and pulls it back. The attachment 11 is further equipped with a liquid tank (not depicted), and has a filling hole 15 at the top to fill cleaning liquid into the tank. Also formed on the base unit 12 is a stem 13, which in particular can telescope, and thus be adjusted to the body size of a user. A handle 14 is arranged at the free end area of the stem 13, and can have an on and off switch or the like.

Even though not shown, the invention can also find application in a cleaning appliance 2 designed for dry cleaning a floor surface by means of the cleaning roller 1. The structural design of the cleaning roller 1 described below remains unaffected by this.

Figure 2:
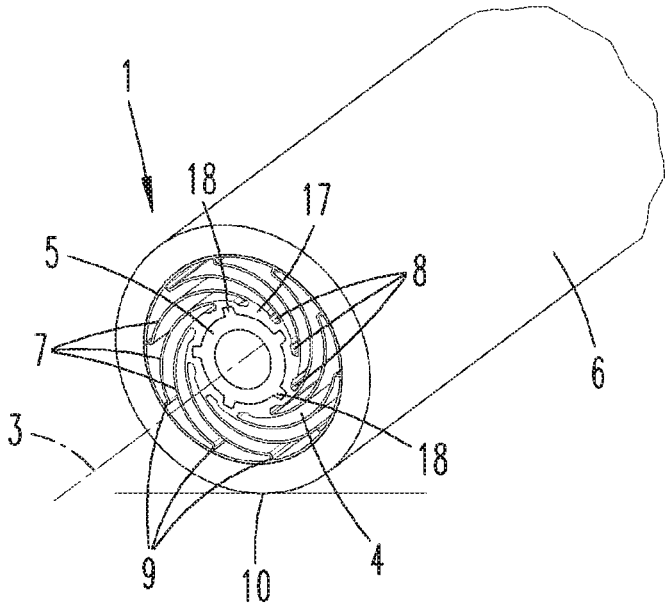
FIG. 2 is a perspective view of a first embodiment of a cleaning roller.
Figure 3:
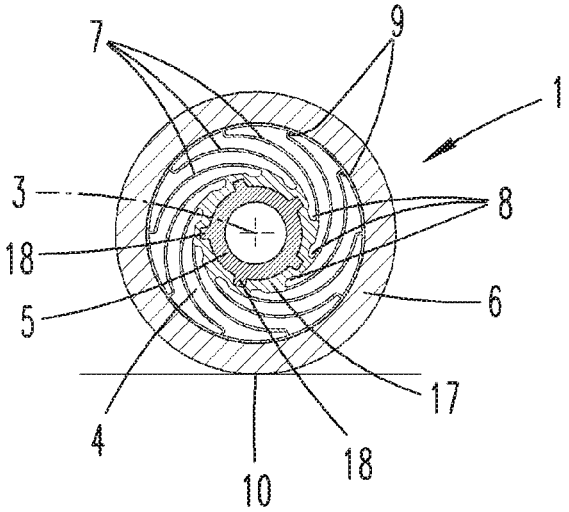
FIG. 3 is a cross section of the cleaning roller according to FIG. 2.

FIGS. 1 and 2 present a perspective view of a first embodiment of a cleaning roller 1. The cleaning roller 1 is essentially designed as a cylindrical body with a longitudinal axis 3. In particular, the cleaning roller 1 consists of a central bearing 5 for holding a drive shaft of the cleaning appliance 2 for rotating the cleaning roller 1, a roller core 4 along with a roller cover 6 enveloping the roller core 4. The roller cover 6 is here a microfiber layer, which is removably slipped onto the roller core 4 in the direction of the longitudinal axis 3. The roller cover 6 can be removed from the cleaning roller 1 for replacement or cleaning purposes. The roller core 4 has a plurality of spring elements 7, which are sickle-shaped, curved lamellae according to this embodiment. The spring elements 7 extend both in the direction of the longitudinal axis 3 of the cleaning roller 1 and in its circumferential direction. The spring elements 7 here consist of an elastically deformable plastic, so that they can be deformed when exposed to a weight force of the cleaning roller 1 or cleaning appliance 2, in particular bent in the direction of the bearing 5. The spring elements 7 each have a first end region 8 and a second end region 9. The first end region 8 is allocated to the bearing 5, while the second end region 9 is allocated to the circumferential area of the roller core 4 adjacent to the roller cover 6. The roller cover 6 here rests directly on the second end regions 9 of the spring elements 7, which form a closed cylindrical circumferential surface of the roller core 4. The roller cover 6 is elastically designed, so that it abuts against the roller core 4 when tensioned, and does not rotate around the roller core 4 while the cleaning roller 1 rotates. The first end regions 8 of the spring elements 7 have a shared end region base 17 with grooves, into which projections 18 of the bearing 5 can engage. The grooves and projections 18 run parallel to the longitudinal axis 3 of the cleaning roller 1, i.e., in a direction perpendicular to the rotational direction of the cleaning roller 1, so that the latter are non-rotatably joined together. FIG. 3 presents a cross sectional view of the cleaning roller 1. In evidence is the sickle shape of the spring elements 7, the concave side of which faces the bearing 5.

Figure 4:
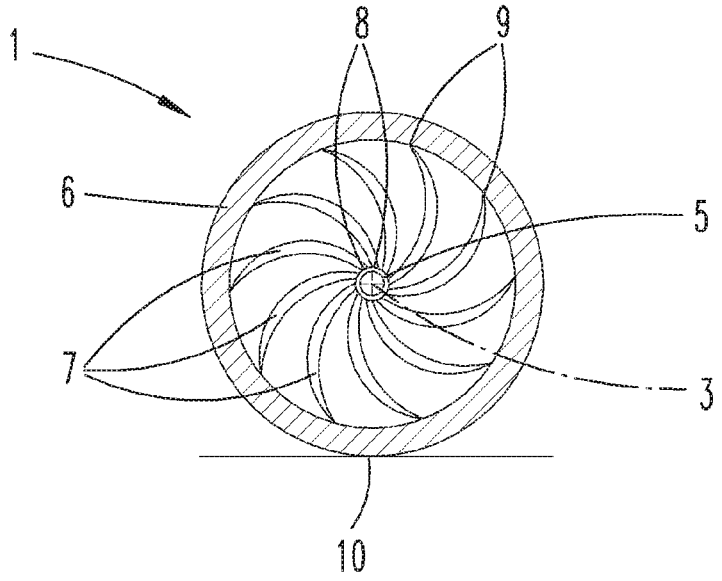
FIG. 4 is a second embodiment of a cleaning roller in an unloaded state.
Figure 5:
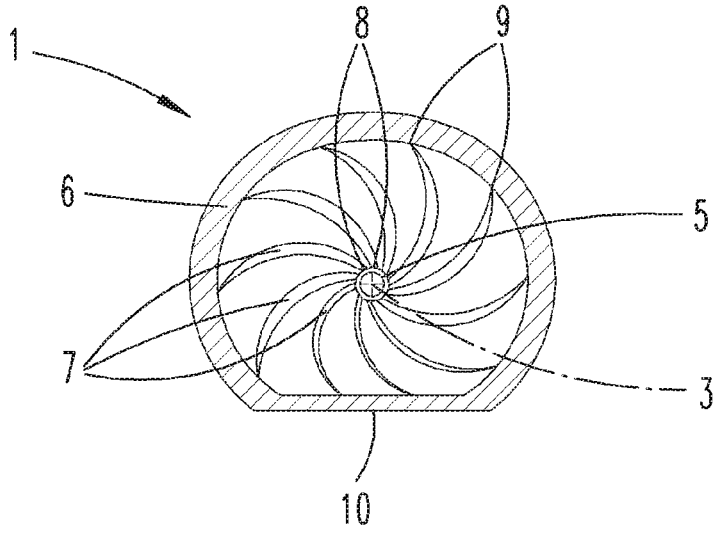
FIG. 5 is the cleaning roller according to FIG. 4 in a loaded state.

FIGS. 4 and 5 show a second embodiment of a cleaning roller 1, in which the unloaded situation (FIG. 4) and loaded situation (FIG. 5) are compared. The cleaning roller 1 is not yet placed on a surface to be cleaned on FIG. 4, so that the spring elements 7 are not yet deformed, with the roller core 4 and roller cover 6 instead still having equidistantly arranged spring elements 7 that have not been deformed through exposure to a weight force of the cleaning roller 1 or cleaning appliance 2. The configuration of the cleaning roller 1 resembles the first embodiment, wherein the bearing 5 is here shown only in simplified point form. In addition, the embodiment according to FIGS. 4 and 5 is distinguished by the fact that the second end regions 9 of the spring elements 7 do not form any closed, cylindrical circumferential surface of the roller core 4, but rather an open structure upon which the roller cover 6 rests. FIG. 5 shows the cleaning roller 1 in a state placed on the surface to be cleaned. In evidence is the bearing area 10, which makes up the contact area between the roller cover 6 and the surface to be cleaned. The weight force of the cleaning roller or cleaning appliance 2 acting on the spring elements 7 compresses the spring elements 7 ending in the bearing area 10. The spring elements 7 allocated to the edge regions of the bearing area 10 are radially expanded, while the spring elements 7 arranged in a central region of the bearing area 10 are essentially compressed. The elongation or spreading of spring elements 7 caused by the compression or expansion widens the bearing area 10 in the circumferential direction, so that the cleaning roller 1 has an especially large bearing area 10 on the surface to be cleaned. At the same time, the circumference of the cleaning roller 1 remains constant, so that the roller cover 6 does not wrinkle, and an optimal cleaning result can be achieved.

Figure 6:
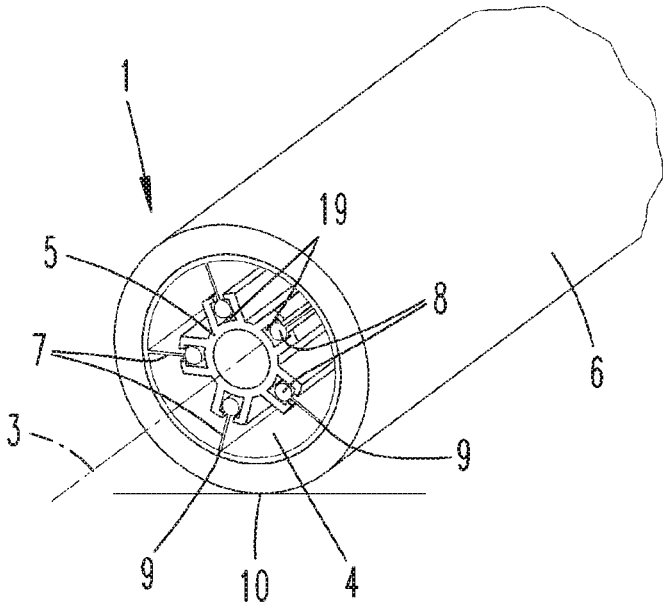
FIG. 6 is a perspective view of a third embodiment of a cleaning roller.
Figure 7:
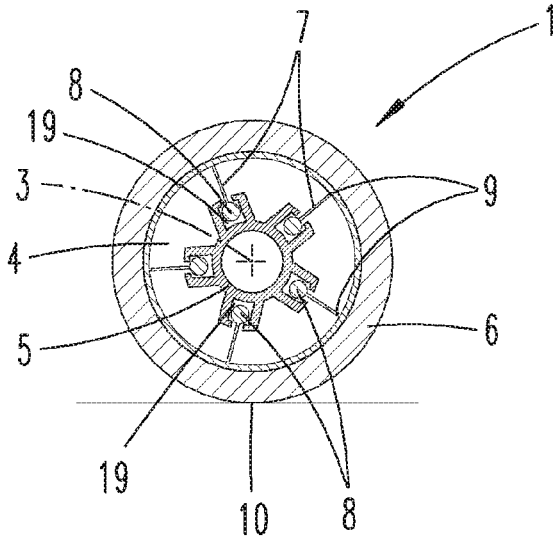
FIG. 7 is a cross sectional view of the cleaning roller according to FIG. 6.

FIGS. 6 and 7 show a third embodiment of the invention, in which the cleaning roller 1 has spring elements 7 formed radially between the bearing 5 and roller cover 6. The spring elements 7 are here plastic disks formed in the direction of the longitudinal axis 3 and protruding radially from the bearing 5. The spring elements are pivoted to the bearing 5, wherein the first end regions 8 of the spring elements 7 each engage into a corresponding groove 19 on the exterior side of the bearing 5. The opening width of the groove 19 and thickness of the spring element 7 determine the maximum possible pivot angle of the spring elements 7 relative to the bearing 5. With the cleaning roller 1 in a loaded state, the spring elements standing on the surface to be cleaned are spaced apart from each other by using the maximum pivot angle on the one hand, and when the spring elements 7 elastically deform on the other. The roller cover 6 is clamped again as a result, thereby yielding the largest possible bearing area 10 on the surface to be cleaned.

Figure 8:
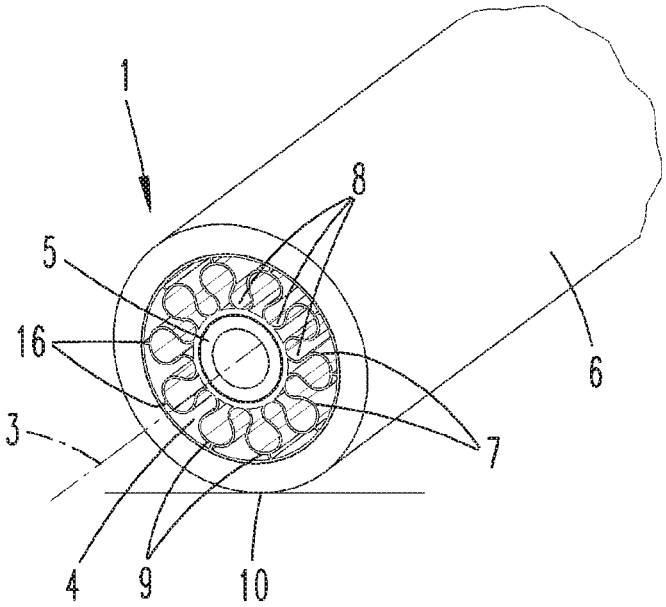
FIG. 8 is a perspective view of a fourth embodiment of a cleaning roller.
Figure 9:
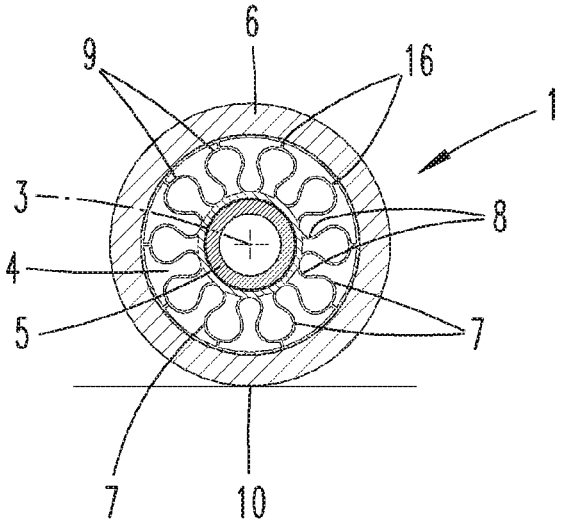
FIG. 9 is a cross sectional view of the cleaning roller according to FIG. 8.

FIGS. 8 and 9 show a fourth embodiment of the invention, in which a plurality of U-shaped spring elements 7 are connected into a meandering shape in the circumferential direction of the roller core 4. Loops of the meandering shape here come about in the circumferential direction, whose curve vertices form the first end regions 8 and second end regions 9, which face in the direction of the bearing 5 on the one hand, and in the direction of the roller cover 6 on the other. The second end regions 9 each have a web 16, which is connected with a cylindrical circumferential surface of the roller core 4. The roller cover 6 abuts against this circumferential surface. When the cleaning roller 1 is exposed to the weight force of the cleaning roller 1 or cleaning appliance 2, the second end regions 9 of the meandering shape facing in the direction of the roller cover 6 are compressed, thereby enlarging the bearing area 10 on the surface to be cleaned, so that the cleaning roller 1 rests on as much of the surface to be cleaned as possible. At the same time, the circumference of the cleaning roller 1 is held constant, so that no wrinkles form on the roller cover 6.

Figure 10:
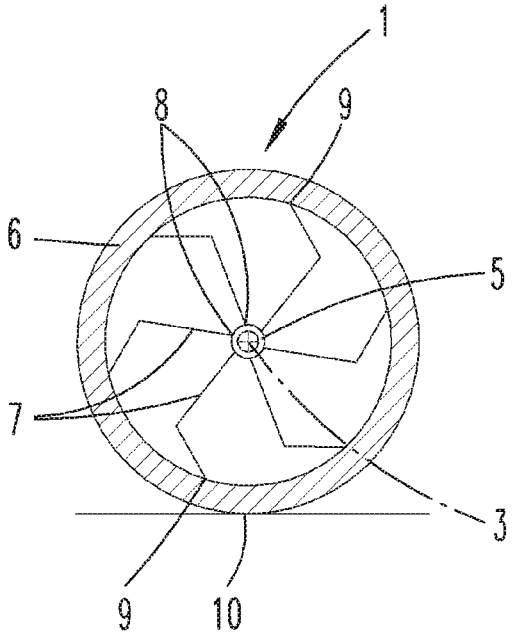
FIG. 10 is a fifth embodiment of a cleaning roller in an unloaded state.
Figure 11:
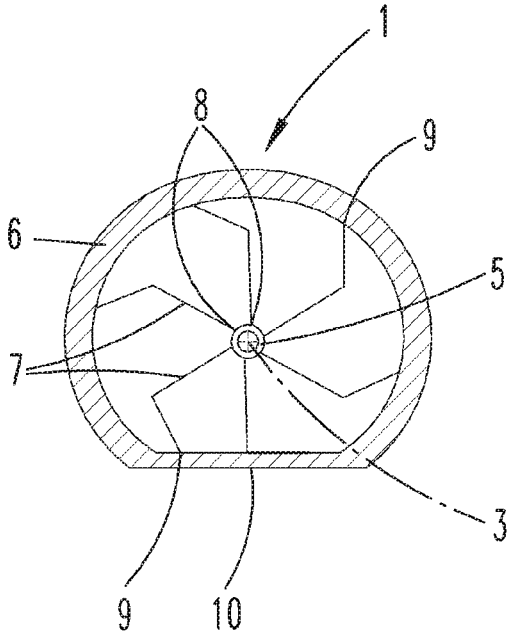
FIG. 11 is the cleaning roller according to FIG. 10 in a loaded state.

The fifth embodiment shown on FIGS. 10 and 11 consists of spring elements 7, which are each L-shaped in design. The material of the spring elements 7 is tapered in the connecting area of the two legs of the L-shape, thereby yielding an elastic deformability similar to a film hinge. When these spring elements 7 are exposed to a weight force, the spring elements 7 are kinked, until advantageously one or several of the legs allocated to the roller cover 6 abut against the roller cover 6. This creates an especially large bearing area 10.

Figure 12:
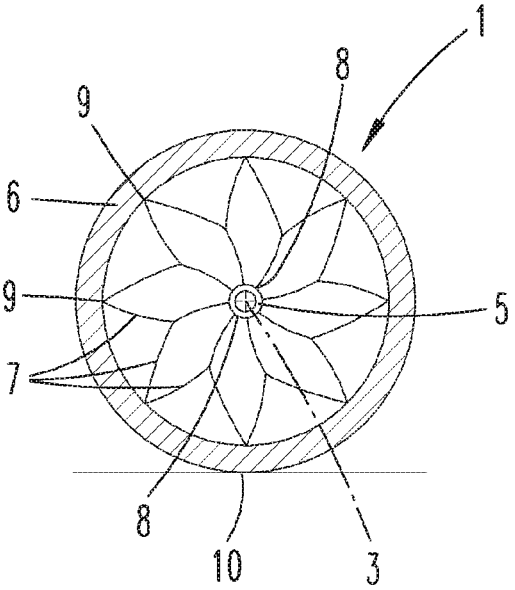
FIG. 12 is a sixth embodiment of a cleaning roller.

FIG. 12 shows a sixth embodiment of a cleaning roller 1, in which the spring elements 7 are each designed like a Y. Each spring element 7 here has a first end region 8, which is arranged on the bearing 5, and two end regions 9, which are arranged on the outer circumference of the roller core 4. When the spring elements 7 are exposed to a load, the two second end regions 9 of a spring element 7 are spaced apart from each other, so that the surface clamped between the two end regions 9 forms an especially large bearing area 10 of the cleaning roller 1.

Figure 13:
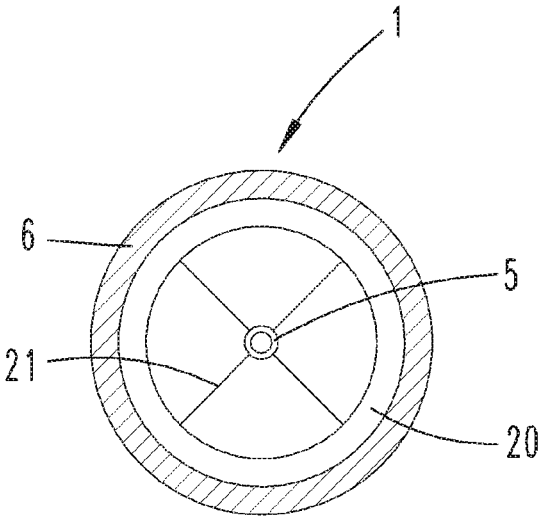
FIG. 13 is a seventh embodiment of a cleaning roller.
Figure 14:
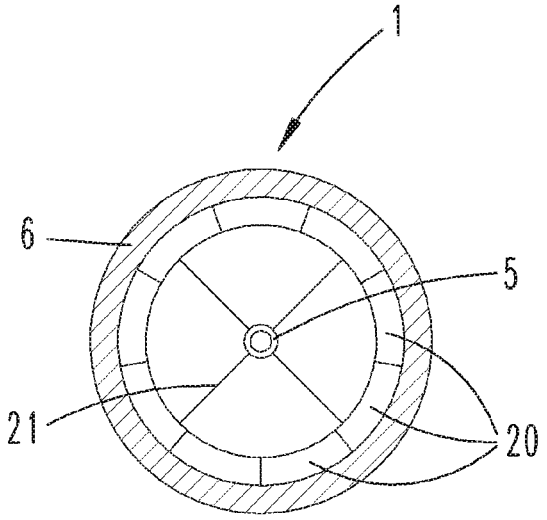
FIG. 14 is an eighth embodiment of a cleaning roller.

FIGS. 13 and 14 show an alternative embodiment of a cleaning roller 1, which has a roller core 4 with an air chamber 20. In particular, the cleaning roller 1 according to 13 has a rim 21 with the central bearing 5. The rim 21 carries the air chamber 20, the exterior side of which is in turn covered by the roller cover 6. The air chamber 20 is here formed with a single air volume. When the air chamber 20 is exposed to the weight force of the cleaning roller 1 or cleaning appliance 2, the circumferential section of the air chamber 20 standing on the surface to be cleaned is pressed together, wherein the partial air volume affected there escapes into the remaining partial circumferential sections of the air chamber 20. The air chamber 20 deviates from the previously essentially circular shape in the bearing area 10, and lies flat against the surface to be cleaned. Among other factors, the air pressure inside of the air chamber 20 and the ambient pressure determine the extent of the flattening. In addition, the size and material of the air chamber 20 play a role, along with the level of weight force applied by the cleaning roller 1 or cleaning appliance 2. In the embodiment according to FIG. 14, the cleaning roller 1 has several air chambers 20, which lie one next to the other in the circumferential direction of the cleaning roller 1. Each air chamber 20 forms a sealed air volume, which extends over a partial circumferential section and in the direction of the longitudinal axis 3 of the cleaning roller 1. When the cleaning roller 1 rests upon a surface to be cleaned, the air chamber 20 adjacent to the surface to be cleaned is compressed, displacing only the air contained within this air chamber 20. The outer circular shape of the air chamber 20 here flattens out, wherein the extent of the flattening is less than in the embodiment according to FIG. 13.

LIST OF REFERENCE NUMBERS

1 Cleaning roller
2 Cleaning appliance
3 Longitudinal axis
4 Roller core
5 Bearing
6 Roller cover
7 Spring element
8 First end region
9 Second end region
10 Bearing area
11 Attachment
12 Base unit
13 Stem
14 Handle
15 Filling hole
16 Web
17 End region base
18 Projection
19 Groove
20 Air chamber
21 Rim

The invention claimed is:

1. A cleaning roller (1) for a cleaning appliance (2) for processing a surface to be cleaned, in the form of a wiping roller for a wet cleaning appliance, wherein the cleaning roller (1) has a roller core (4) that has a closed cylindrical circumferential surface and that can rotate around a longitudinal axis (3), with a bearing (5) for a drive shaft and a roller cover (6) that is removably attached to the cylindrical circumferential surface of the roller core (4) and that surrounds the roller core (4) in the circumferential direction, wherein the roller core (4) has several spring elements (7) arranged one next to the other in the circumferential direction of the cleaning roller (1) relative to a cross section perpendicular to the longitudinal axis (3), which each extend from the bearing (5) to the roller cover (6), wherein the spring elements (7) are essentially U-shaped in design, wherein adjacent spring elements (7) are meanderingly connected with each other in the circumferential direction.

2. The cleaning roller (1) according to claim 1, wherein the spring elements (7) are fabricated out of an elastically deformable material, in particular a plastic.

3. The cleaning roller (1) according to claim 1, wherein a first end region (8) of a spring element (7) is allocated to the bearing (5), and a second end region (9) of the spring element (7) is allocated to the roller cover (6), wherein both the first end regions (8) and the second end regions (9) of adjacent spring elements (7) are spaced apart from each other in the circumferential direction.

4. The cleaning roller (1) according to claim 1, wherein the spring elements (7) are designed radially between the bearing (5) and roller cover (6).

5. The cleaning roller (1) according to claim 1, wherein the spring elements (7) are formed over the entire length of the cleaning roller (1) in the direction of the longitudinal axis (3).

6. A cleaning appliance (2) with a rotatable cleaning roller (1) having a roller core (4) has a closed cylindrical circumferential surface and that can rotate around a longitudinal axis (3), with a bearing (5) for a drive shaft and a roller cover (6) that is removably attached to the cylindrical circumferential surface of the roller core (4) and that surrounds the roller core (4) in the circumferential direction, wherein the roller core (4) has several spring elements (7) arranged one next to the other in the circumferential direction of the cleaning roller (1) relative to a cross section perpendicular to the longitudinal axis (3), which each extend from the bearing (5) to the roller cover (6), wherein the spring elements (7) are essentially U-shaped in design, wherein adjacent spring elements (7) are meanderingly connected with each other in the circumferential direction.

* * * * *